United States Patent [19]

van Esdonk et al.

[11] 3,936,688

[45] Feb. 3, 1976

[54] GAS DISCHARGE PANEL HAVING ELECTRODES SECURED TO FLAT INSULATING PLATES BY MEANS OF GLAZE

[75] Inventors: Johannes van Esdonk; Johannes Petrus Hornman, both of Eindhoven, Netherlands

[73] Assignee: U.S. Philips Corporation, New York, N.Y.

[22] Filed: Nov. 22, 1974

[21] Appl. No.: 526,133

[30] Foreign Application Priority Data

Dec. 22, 1973 Netherlands ..... 7317648

[52] U.S. Cl. ..... 313/220; 313/188

[51] Int. Cl.[2] ..... H01J 61/30

[58] Field of Search ..... 313/188, 220

[56] References Cited

UNITED STATES PATENTS 3,842,308 10/1974 Van Esdonk et al. ..... 313/188

*Primary Examiner*—R. V. Rolinec
*Assistant Examiner*—Darwin R. Hostetter
*Attorney, Agent, or Firm*—Frank R. Trifari; Carl P. Steinhauser

[57] ABSTRACT

A gas discharge panel in which at least the electrodes serving as cathodes are separated from each other by partitions which consist of electrically oxidized aluminum strips which, like the cathodes, are also connected to a flat insulating plate by means of glaze.

3 Claims, 5 Drawing Figures

Figure 1:
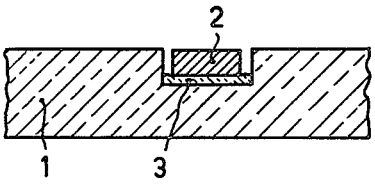

GAS DISCHARGE PANEL HAVING ELECTRODES SECURED TO FLAT INSULATING PLATES BY MEANS OF GLAZE

The invention relates to a gas discharge panel at least consisting of an insulating base plate and an insulating transparent top plate, which plates each have a set of parallel conductors, the conductors of the base plate and the top plate crossing each other an an angle, cavities being present at the crossing, in which cavities an electric discharge can occur, the conductors of at least one set being secured to the insulating plate by means of a low melting-point glass (glaze), the sides of adjacent conductors being separated by insulating partitions.

From the U.S. Pat. No. 3,634,720, for example, it is known to provide conductors of a gas discharge panel in grooves of an insulating plate.

However, the provision of such grooves in an insulating plate, in particular a glass plate, is time-consuming and hence expensive. When the grooves have been obtained by means of chemical etching, the cross-section moreover does not have the desired U-shape so that the conductors do not fit accurately in the grooves and their position therein is thus not accurately determined. As a result of this it is also possible that the gas discharges creep along the sides of the conductors to the lower side, as a result of which the luminous efficiency of the discharge decreases considerably. Moreover, during the (aging) burning in period the upper surface of the conductor is not cleaned sufficiently of oxides so that a large spreading in the ignition voltage and the operating voltage of the discharges at different crossings is obtained.

If the conductors are not placed in grooves but on the surface of an insulating plate, the drawback is experienced that discharges can occur between the sides of adjacent conductors. This can be avoided by coating the sides by means of glaze which can become thinly liquid and form a meniscus against said sides, as described in the prior application which has been published as Dutch Patent application No. 71.08.935. A drawback is that a glaze which becomes so thinly liquid has a higher melting temperature, namely 570°C. As a result of this a comparatively thick oxide layer is formed on the conductors for the electrodes which usually consist of chromium-nickel-iron (5% by weight of Cr, 47.5% by weight of Ni, 47.5% by weight of Fe), so that the above-mentioned difficulty during the burning in period (aging) is considerably increased.

The said drawbacks can be avoided entirely in an above described gas discharge panel in which the sides of adjacent conductors are separated by partitions if, according to the invention, the partitions consist of superficially oxidized aluminium strips which are secured on the insulating plate. Such strips constitute with the insulating plate grooves having a U-shaped cross-section and accurately defined dimensions. As a result of this the partitions may engage the sides of the parallel conductors closely so that the discharges can no longer proceed along the sides to the lower side of the electrodes. The comparatively thin oxide layer on the electrode strips formed at the lower melting temperature of said glaze is removed entirely from the upper side of said strips during the burning in period (aging).

Moreover, the time for this purpose is comparatively short as compared with the time necessary to remove an oxide layer formed at 570°C (3 hours instead of 30 hours).

The alternate provision beside each other of partitions and electrodes can simply be carried out by placing the partitions in the form of a slot grid of electrically oxidized aluminum on an insulating plate which has previously been covered with a layer of powdered glaze suspension. By placing the chromium-nickel-iron conductors, also in the form of such a slot grid, between the strips of the oxidized aluminum grid and heating the assembly until the glaze melts, the conductors and the partitions after cooling are secured to the insulating plate. After cutting off the frames from both grids the panel plate is ready. The depth of the "grooves" is determined by the thickness of the aluminum plate of which the partitions are manufactured and may thus be very accurate.

Figure 2:
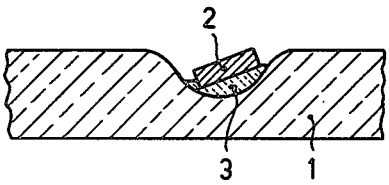
Figure 3:
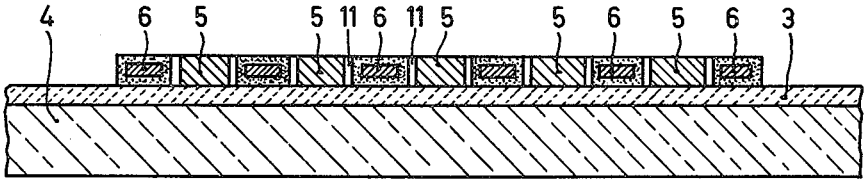
Figure 4:
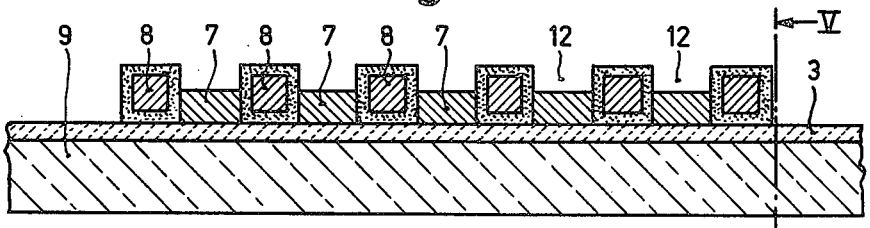
Figure 5:
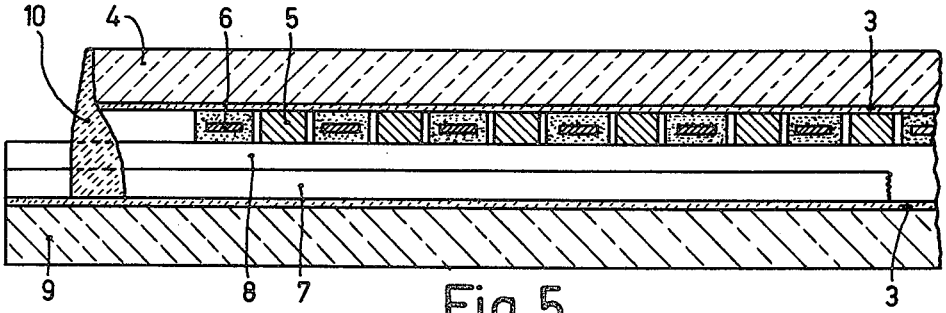

The invention will be described in greater detail with reference to the accompanying drawing, in which:

FIG. 1 is a cross-sectional view of the desired position of conductors in grooves of a panel plate, and FIG. 2 is a cross-sectional view of a panel plate in the form as it occurs in practice, while FIGS. 3 and 4 are cross-sectional views of embodiments of panel plates and FIG. 5 is a sectional view of a panel according to the invention.

Reference numeral 1 in FIG. 1 denotes a glass base plate in which a groove is ground in which a metal strip 2 is secured by means of glaze 3 preferably consisting of "Pyroceram." Said Pyroceram has the advantage that it can be provided as a suspension of a powder which melts at a temperature of 440°C. At said temperature the glaze crystallizes so that the melting temperature increases considerably. Therefore, the glaze no longer melts if afterwards, when several panel plates are sealed together in a vacuum-tight manner, the same glaze is melted on the edges of the plates at 440°C.

Since the grinding of a large number of grooves is expensive, the grooves are usually provided by etching. In that case, however, the cross-section of the groove is no longer truly rectangular but the shape as is shown in FIG. 2 is obtained. It is then possible that an electrode 2 becomes located in a groove in an inclined position which is undesired.

According to the invention, in the embodiment shown in FIG. 3 the layer of glaze is provided on the glass plate 4. The conductors 5 are placed on the layer of glaze 3. Electrically oxidized aluminum strips are provided between the conductors 5. So the glaze 3 secures the strips 5 and 6 to the glass plate 4. If the strips 5 serve as cathodes, hence no discharges can occur between the sides of adjacent strips 5.

According to the embodiment shown in FIG. 4, the height of the oxidized aluminum strips 8 is larger than the thickness of the metal strips 7. As a result of this, discharge cavities are formed by the grooves 12 upon placing two plates 9 on each other or upon placing a plate 9 and a plate 4 on each other. The plates are placed on each other in such manner that the conductors cross each other at an angle, generally a right angle. In this case it makes no difference which of the sets of conductors is connected as cathodes.

The panel plates shown in FIG. 4 may also be placed on each other with the interposition of an aperture plate and thus constitute a discharge panel. The cavities of the aperture plate then communicate with each other through the slots 11 between the conductors 5 and the strips 6. As a matter of fact, the glaze 3, in this case Pyroceram, does not become so thinly liquid that it is drawn into the grooves 11 in a capillary manner.

The strips 5,6,7, and 8 can be placed on the glass plate 4,9 covered with glaze before the glaze 3 is melted, but they may also be pressed into the soft glaze after melting. For that purpose, both the strips 5,7 and the oxidized aluminum strips 6,8 in the form of a slot grid are manufactured from a metal plate and stretched taut while being placed on the glass plate. The connection frames at the ends of the strips are removed afterwards.

In the embodiment of a panel shown in FIG. 5, a plate 9 is used as a base plate on which a plate 4 is placed rotated through 90°. The plates 9 and 4 are secured together in a vacuum-tight manner at the edges by means of glaze 10, preferably also Pyroceram, the strips 7 and 5, respectively, projecting beyond the vacuum space so that they can be connected to current supply conductors. Further, the panel has an exhaust tube (not shown). The glaze 10 must have a lower melting temperature than the glaze 3 after connecting the strips to the glass plates 4 and 9, respectively.

Instead of Pyroceram, a glaze 3 in the form of a non-crystallizing glaze having a higher melting temperature than that of the glaze 10 may also be used. The advantage of Pyroceram is, however, that it may serve both purposes in that the softening temperature after melting increases as a result of crystallization of the glaze.

Although a single embodiment of a gas discharge panel has been described, other embodiments are also possible without departing from the scope of this invention. The strips serving as anodes may be laid in known manner loosely in grooves or between strips 6 and 8, respectively, and be fixed in the grooves at the ends only by means of glaze.

If the strips serving as cathodes are located between the oxidized aluminum strips so that they fit tightly, they need not be secured with glaze throughout their length since in that case the discharges cannot penetrate into the slots 11 all the same. There is no danger of the discharges starting creeping below the strips 5.

What is claimed is:

1. A gas discharge panel comprising an insulating base plate and an insulating transparent top plate, said plates each having a set of parallel conductors, the conductors of the base plate and the top plate crossing each other at an angle and defining cavities therebetween in which an electric discharge can occur, the conductors of at least one set being secured to the insulating plate by means of a glass which melts below 570°C, the sides of adjacent conductors being separated by insulating partitions of superficially oxidized aluminum strips which are secured on the insulating plate.

2. A gas discharge panel as claimed in claim 1, wherein said glass consists of a readily crystallizing glaze.

3. A gas discharge panel as claimed in claim 1 wherein the oxidized aluminum partitions of at least one of the panel plates have a larger height than the electrode strips.

* * * * *